US006086440A

United States Patent [19]

Fechtner

[11] Patent Number: 6,086,440

[45] Date of Patent: Jul. 11, 2000

[54] SWIM FIN AND MONOFIN WITH FLAPPING FOIL

[76] Inventor: Ryszard Fechtner, 8748 Jade Ct., Boynton Beach, Fla. 33437

[21] Appl. No.: 09/228,116

[22] Filed: Jan. 11, 1999

[51] Int. Cl.[7] ..... A63B 31/08

[52] U.S. Cl. ..... 441/64

[58] Field of Search ..... 441/55, 60, 61, 441/62, 63, 64

[56] References Cited

U.S. PATENT DOCUMENTS

| | | | |
|---|---|---|---|
| 2,094,532 | 9/1937 | Glad | 9/21 |
| 2,343,468 | 3/1944 | Messinger | 9/21 |
| 2,729,832 | 1/1956 | Schmitz | 9/21 |
| 3,055,025 | 9/1962 | Ferraro | 9/309 |
| 3,178,738 | 4/1965 | Trell | 9/309 |
| 3,183,529 | 5/1965 | Beuchat | 9/309 |
| 3,810,269 | 5/1974 | Tabata | 9/306 |
| 4,300,255 | 11/1981 | Beuchat | 9/309 |
| 4,541,810 | 9/1985 | Wenzel | 441/64 |
| 4,657,515 | 4/1987 | Ciccotelli | 441/64 |
| 4,664,639 | 5/1987 | Schneider | 441/61 |
| 4,781,637 | 11/1988 | Caires | 441/61 |
| 4,832,644 | 5/1989 | Roberts | 441/64 |
| 4,929,206 | 5/1990 | Evans | 441/64 |
| 4,940,437 | 7/1990 | Piatt | 441/62 |
| 5,151,060 | 9/1992 | Lam | 441/62 |
| 5,163,859 | 11/1992 | Beltrani | 441/64 |
| 5,348,503 | 9/1994 | Fechtner | 441/56 |
| 5,356,323 | 10/1994 | Evans | 441/64 |
| 5,401,196 | 3/1995 | Triantnfyilou | 440/13 |
| 5,429,536 | 7/1995 | Evans | 441/64 |
| 5,597,336 | 1/1997 | Evans | 441/64 |
| 5,649,845 | 7/1997 | Fechtner | 441/56 |

*Primary Examiner*—Mark T. Le
*Assistant Examiner*—Patrick Craig Muldoon
*Attorney, Agent, or Firm*—Alvin S. Blum

[57] ABSTRACT

A swim fin for each foot or a monofin for both feet of a swimmer has an elastic flapping foil that bends away from the ball of the foot on the kicking stroke in which the instep is advanced first, and that is forced against the sole of the of the foot on the opposite stroke. this greatly enhances the efficiency of the kicking action. The free edge of the flapping foil may be curled upward to further enhance the flapping action.

23 Claims, 5 Drawing Sheets

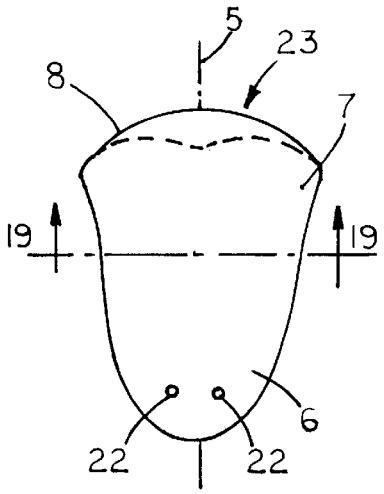
FIG. 18
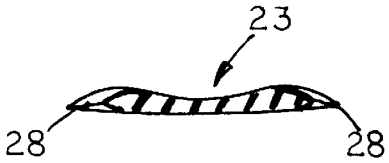
FIG. 19
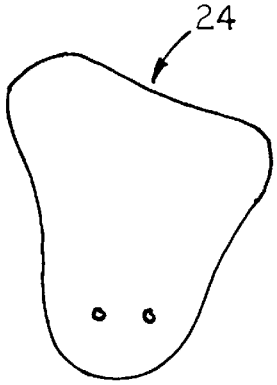
FIG. 20
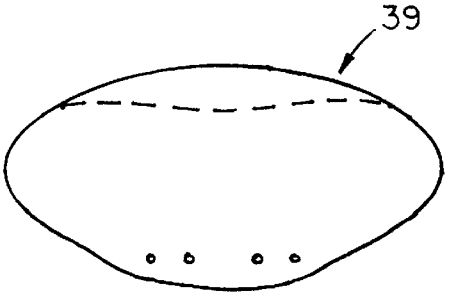
FIG. 21
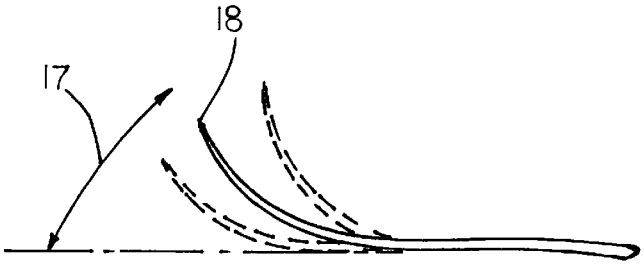
FIG. 22
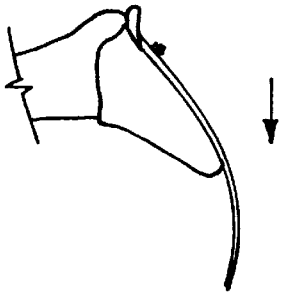
FIG. 23
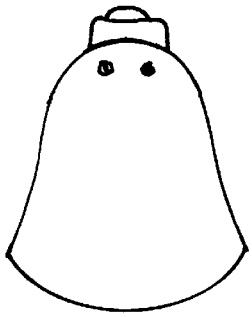
FIG. 23-A

FIG. 25-A

SWIM FIN AND MONOFIN WITH FLAPPING FOIL

BACKGROUND OF THE INVENTION

This invention relates to foot operated swimming aids, and more particularly to improved swim fins for attachment to individual feet or monofins for attachment to both feet. Swim fins of many different shapes and operating features have been invented in an attempt to increase the propulsion effeciency of a swimmer's leg action. U.S. Pat. No. 3,055,025 issued Sep. 25, 1962 to Ferraro presents a vector analysis demonstrating how certain portions of the stroke actually push the swimmer backward with conventional swim fins. U.S. Pat. Nos. 5,597,336; 4,929,206; 5,356,323; and 5,429,536 issued to Evans disclose fin blades with lateral elements that bend toward each other for enhanced efficiency. U.S. Pat. No. 4,664,639 issued May 12, 1987 to Schneider teaches a foot fin with a foil or flap hinged to the forward part of the shoe and extending backward therefrom. There is reduced resistance in moving the foot forward and increased resistance in moving the foot backward. It is employed with the user floating upright in a walking motion. U.S. Pat. No. 2,343,468 issued Mar. 7, 1944 to Messinger teaches a foil attached pivotally to the toe and extending outward therefrom. U.S. Pat. No. 3,178,738 issued Apr. 20, 1965 to La Trell teaches a fin that fastens to a shoe. Continued attempts to improve the efficiency of swim fins indicates that a need still exists for improvements in the art so that the strength of the human leg muscles may be more effectively employed for aquatic propulsion.

SUMMARY OF THE INVENTION

It is accordingly an object of the invention to provide foot operated swimming devices that will provide enhanced forward propulsion from the leg motions of a swimmer. It is a further object that the improvements be applicable to a variety of such devices including a fin for an individual foot, a fin that attaches to two feet (a monofin), and fins that removably attach to shoes. The fin assembly of the invention includes means for mounting on one or both feet, and an elastic, resilient foil or blade fixed or removably attached to the foot mounting means. The foil member has a curved free edge that curves about an axis or axes transverse to the long axis of the foil and that curves up toward the foot. We label the kicking motion as a first stroke with the dorsum of the foot advancing and the second stroke with the sole of the foot advancing through the water. The arcuate free edge encourages bending of the foil away from the foot on the first stroke and toward the foot on the second stroke. The foil member bent transverse to the long axis snaps back elastically at the end of the first stroke, transferring the stored elastic energy into forward propulsion, and the angle through which the foil bends facilitates transfer of kicking force into forward propulsion. Those fins of the prior art featuring lateral bending of the foil derive less forward force when the sides snap back because the two sides generate opposing forces. When the foil of the invention is attached to the foot attaching element so that the foil member is freely movable at the ball of the foot and/or at the longitudinal arch, the flexing action of the foil is further enhanced in bending to angles that enable the motions of the foil through the water to increase the forward propulsion vector of the strokes. The foil member may be attached, for example, at, or near, the heel portion of the foot attaching element.

These and other objects, advantages, and features of the invention will become more apparent when the detailed description is studied in conjunction with the drawings.

BRIEF DESCRIPTION OF THE DRAWINGS

FIG. 18 is a top plan view of symmetrical flapping foil for swim fin FIG. 1.

FIG. 19 is a section of the flapping foil taken along section 19—19 of FIG. 18.

FIG. 20 is a top plan view of asymmetrical flapping foil for swim fin FIG. 1.

FIG. 21 is a top plan view of flapping foil for monofin FIG. 5.

FIG. 22 is a left side view of bending of flapping foil.

FIG. 23 is a left side view of swim fin FIG. 1 during the second stroke.

FIG. 23-A is a bottom view of swim fin FIG. 1 during the second stroke.

FIG. 25-A is a bottom view of swim fin FIG. 1 during the first stroke.

DETAILED DESCRIPTION OF PREFERRED EMBODIMENTS

Figure 1:
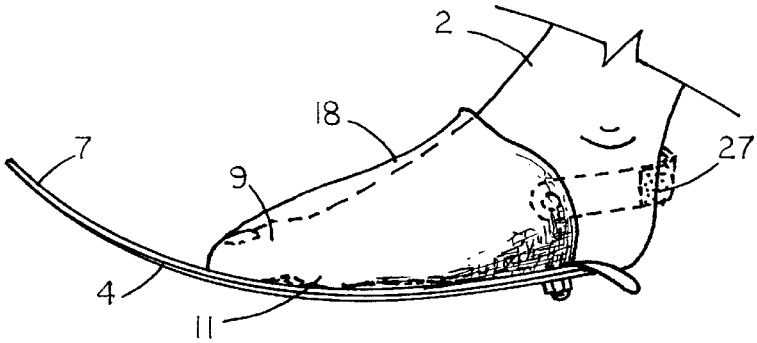
FIG. 1 is a left plan view of a swim fin showing foot attaching portion and flapping foil.
Figure 2:
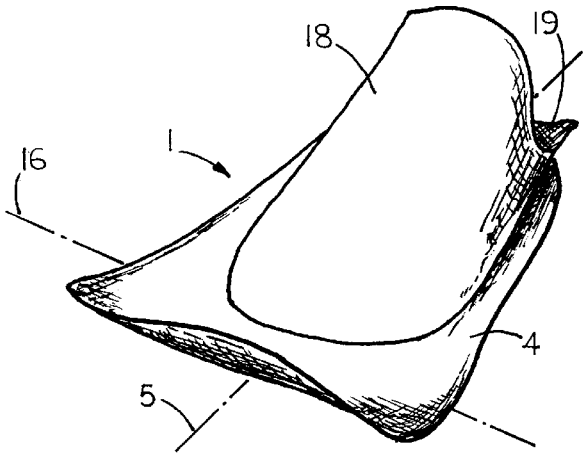
FIG. 2 is a top perspective view of the swim fin FIG. 1.
Figure 3:
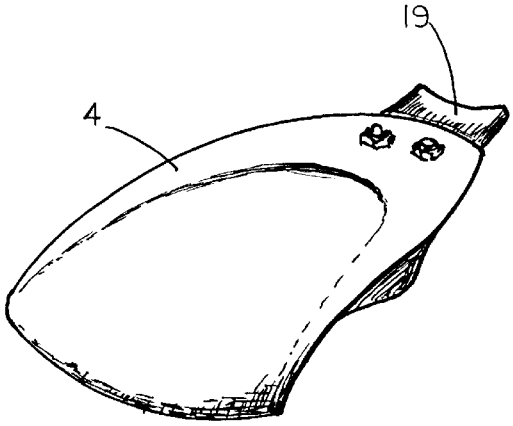
FIG. 3 is a bottom perspective view of the swim fin FIG. 1.
Figure 4:
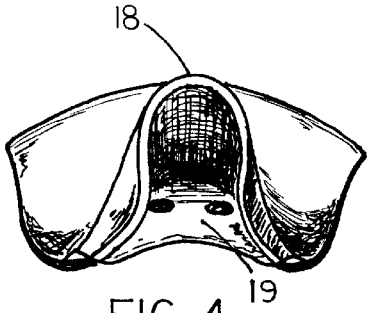
FIG. 4 is an end view of the swim fin FIG. 1.

Referring now first to FIGS. 1–4, 9–13, and 18–25A, a flexible fin assembly 1 of the invention has a foot receiving portion or foot attaching element 3 for removably attaching the foot 2 of a swimmer to the assembly. The foot attaching element 3 may have a soft molded upper portion 18 for more gentle engagement of the sensitive instep of the foot and a stiffer base 19 for engaging the less sensitive sole of the foot.

A broad thin elastic foil member 4 has a long axis 5, a narrow forward portion 6 that is attached to the heel portion 21 of base 19 by fasteners 22. Optionally, the foil member 4 may be replaced with another foil member having different properties such as length, stiffness, degree of curvature and the like. Alternatively, the entire assembly may be molded in one piece (not shown).

Figure 12:
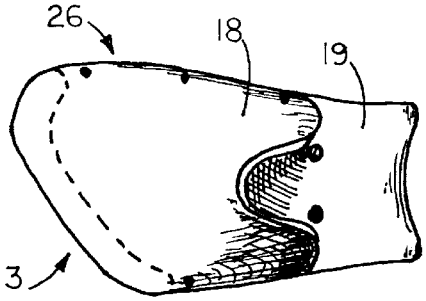
FIG. 12 is a top view of asymmetrical foot attaching portion FIG. 1.
Figure 13:
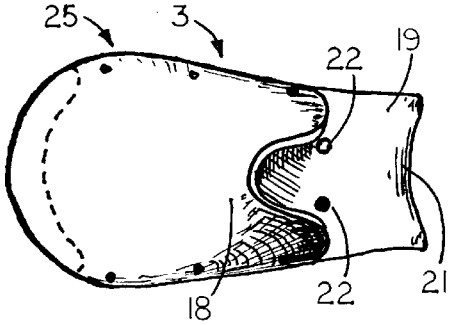
FIG. 13 is a top view of symmetrical foot attaching portion FIG. 1.

The foil member has a wider rear portion 7 with a free edge 8 that extends beyond the toes 9 of the swimmer. The foil member is sufficiently resilient or elastic that it will bend away from the base 19 and the ball 11 of the foot when the foot is moved through the water with the instep or dorsum of the foot advancing first through the water in what we term the first stroke. It will store elastic energy that will be released at the end of the stoke by squeezing water between the foil and the base of the foot attaching element. The foot is then moved sole first in the second stroke of the kicking action. In a preferred embodiment of the fin, the free edge 8 may be provided with an upward curl, bending about an axis 16, or axes, transverse to the long axis 5. This initial curvature may provide an enhanced forward vector on one or both strokes, and contribute to bending the foil away from the ball of the foot during the second stroke to provide a better angle of attack for converting more of the kicking stroke energy into forward propulsion of the swimmer. The degree of curvature may vary from an angle 17 of between about five degrees and ninety degrees (FIG. 22). The foil member may have the same symmetrical shape 23 for each foot (FIG. 18), or the foil may have an asymmetrical shape 24 (FIG. 20) for each foot to reduce interference when kicking. In like fashion, the foot attaching element may be symmetrical 25 (Fif. 13) or asymmetrical 26 (FIG. 12).

The initial curvature of the free edge gives it greater resistance during the start of the first stroke (FIG. 24) to enhance bending away from the base. This curvature straightens out (FIG. 25) during later stages of the first stroke to provide a better angle of attack for forward propulsion.

Figure 15:
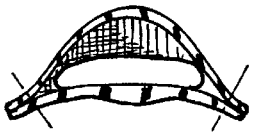
FIG. 15 is a section of the foot attaching portion taken along section line 15—15 of FIG. 14.
Figure 14:
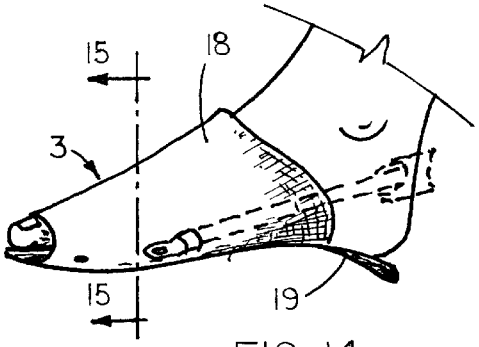
FIG. 14 is a left plan view of foot attaching portion with open toe section.

The fin assembly may optionally be provided with an ankle strap 27. As shown in FIG. 19 the foil 23 may be thinned at the lateral edges 28 to reduce weight and balance bending forces. As shown in FIGS. 14, 15, the foot attaching element 3 may optionally have an open toe configuration as is well known in the art.

Figure 16:
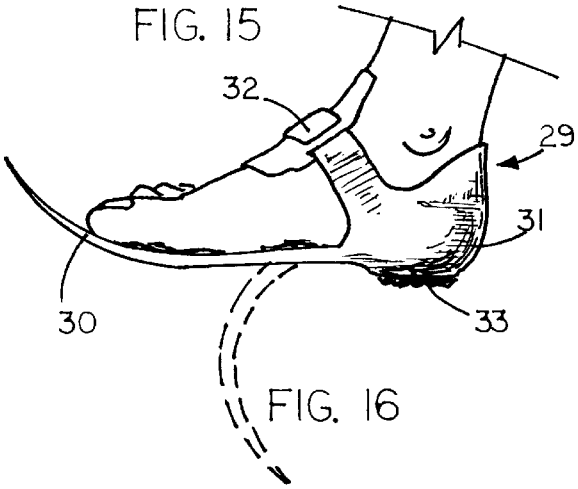
FIG. 16 is a left plan view of beach shoe with sole as flapping foil.
Figure 17:
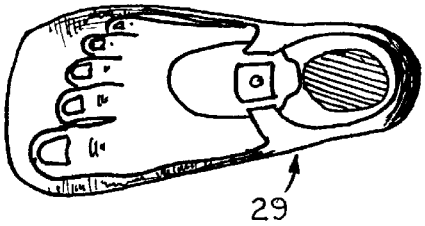
FIG. 17 is a top view of beach shoe FIG. 16.
Figure 24:
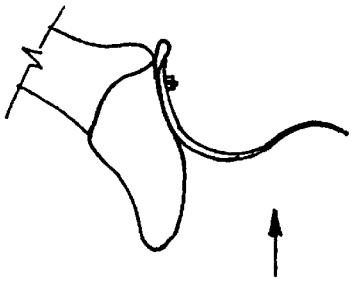
FIG. 24, FIG. 25 is a left side view of swim fin FIG. 1 during the first stroke.
Figure 25:
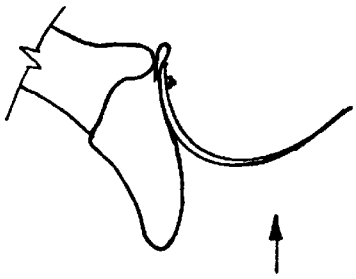

In the embodiment of the invention shown in FIGS. 16 and 17, a beach shoe 29 is provided with an elastic sole 30 that extends beyond the toes and bends away from the sole of the users foot. A fixed heel cup 31 and ankle strap 32 hold the foot in place, and the sole of the beach shoe has a heel portion 33 that is fixed in place on the foot and a sole portion 30 that bends in the flapping foil action described above.

Figure 8:
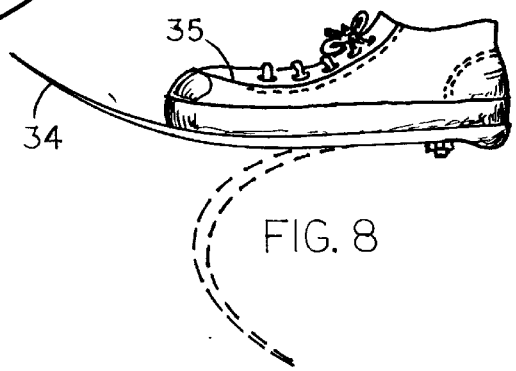
FIG. 8 is a left plan view of regular shoe with flapping foil attached to it.
Figure 9:
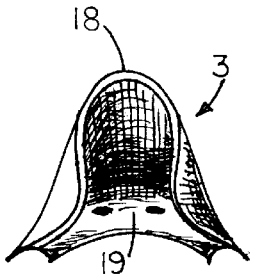
FIG. 9 is an end view of foot attaching portion FIG. 1.
Figure 10:
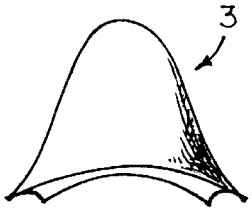
FIG. 10 is a front view of foot attaching portion FIG. 1.
Figure 11:
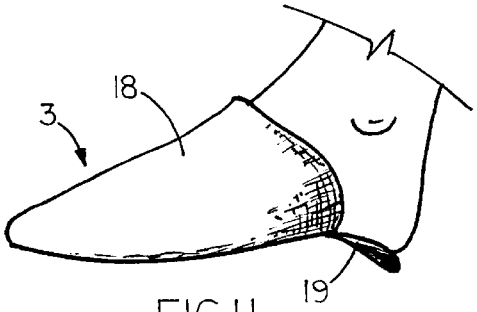
FIG. 11 is a left plan view of foot attaching portion FIG. 1.

FIG. 8 shows another embodiment of the invention in which the flapping foil 34 is removably attached to a shoe 35.

Figure 26:
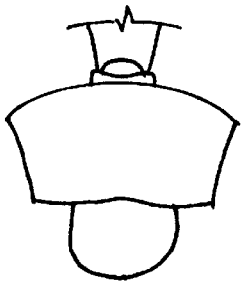
FIG. 26 is a side view of another embodiment of the invention at rest.
Figure 26:
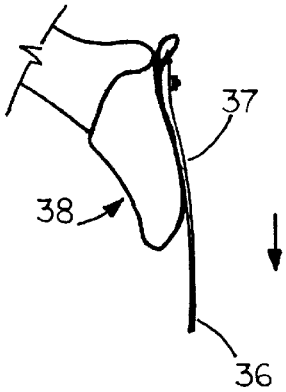
Figure 27:
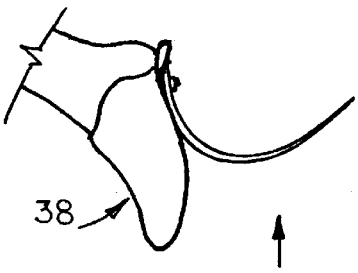
FIG. 27 is a side view of swim fin FIG. 26 during the first stroke.
Figure 28:
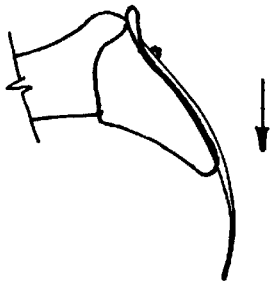
FIG. 28 is a side view of swim fin FIG. 26 during the second stroke.

Referring now to FIGS. 26–28, an alternative embodiment 38 of the invention is shown in which the free edge 36 of the flapping foil 37 is straight, and not bent, when at rest.

Figure 5:
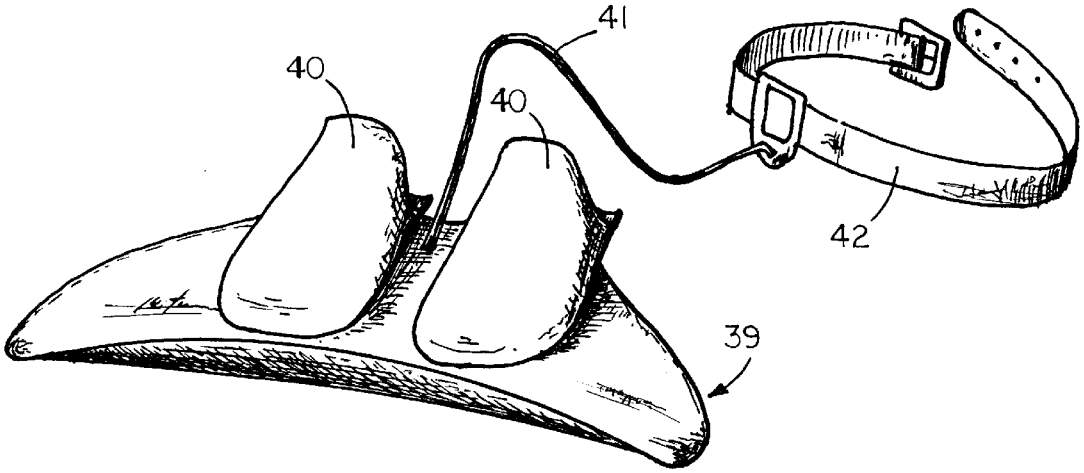
FIG. 5 is a top perspective view of a monofin showing feet attaching portions and flapping foil.
Figure 6:
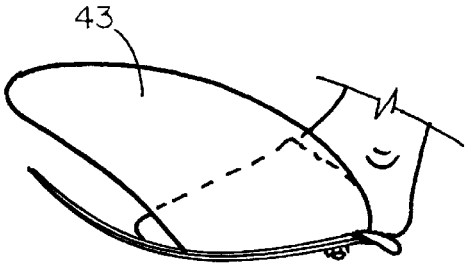
FIG. 6 is a left side view of the monofin FIG. 5 with vertical stabilizer.
Figure 7:
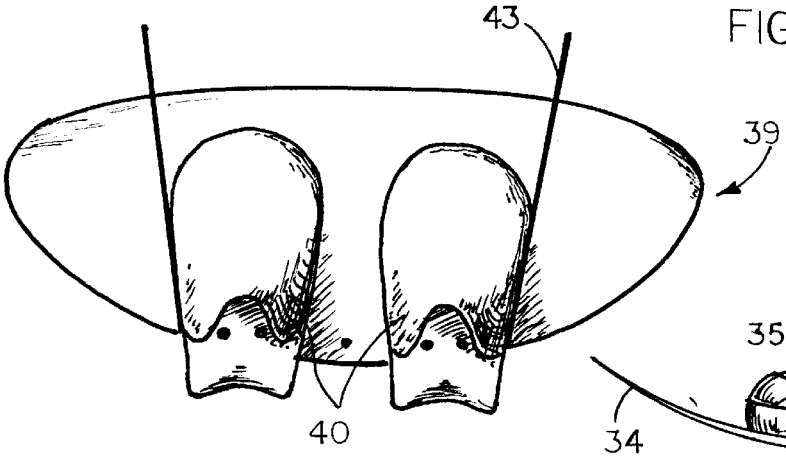
FIG. 7 is a top plan view of the monofin FIG. 5 with two vertical stabilizers.

Referring now to FIGS. 5–7, another embodiment of the invention is a single swim assembly 39 that attaches to two feet by means of a pair of foot attaching elements 40. This is often referred to as a monofin. The flapping foil 41 functions as described above for a single foot fin. The monofin may be provided with a tether cord 41 and belt 42 to enable the user to slip out of the assembly as required without concern about losing the assembly.

Thin flat keels 43 that are attached to the foot attaching elements 40 may also be provided. These run perpendicular to the foil member and parallel to a long axis in a heel to toe direction. The keels provide side to side stabilization when the monofin is used with underwater paddles.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A flexible fin assembly operable when attached to at least one foot of a swimmer, said fin assembly comprising:

A) at least one foot attaching element for attaching to at least one foot, or a portion thereof, of a swimmer;

B) a broad, thin, elastic foil member having a long axis extending from a first end, along a narrow first portion, and a wider second portion to a free edge extending beyond the swimmer's toes; and C) means attaching said first end to said at least one foot attaching element beneath the foot such that, when operated by the swimmer, said foil member will bend in an arc transverse to said long axis away from the ball of the foot held in the foot attaching element when the foot is forced through the water with the dorsum of the foot advancing first and said foil member will bend up toward said ball on an opposite foot motion.

2. The fin assembly according to claim 1, in which the second portion is provided with an arcuate shape curving toward the foot about an axis transverse to the long axis through an angle of between five and ninety degrees.

3. The fin assembly according to claim 2, in which there are two foot attaching elements for attaching to two feet.

4. The fin assembly according to claim 3 further comprising tether means extending from said fin assembly for connection to a body part of the swimmer to prevent loss of said fin assembly.

5. The fin assembly according to claim 4 further comprising at least one thin, flat, broad keel element attached to the foot attaching element and oriented in a plane parallel to said long axis and perpendicular to the foil member.

6. The fin assembly according to claim 1, in which there is a single foot attaching element for attaching to one foot.

7. The fin assembly according to claim 1, in which there are two foot attaching elements for attaching to two feet.

8. The fin assembly according to claim 7 further comprising tether means extending from said fin assembly for connection to a body part of the swimmer to prevent loss of the fin assembly.

9. The fin assembly according to claim 8 further comprising at least one thin, flat, broad keel element attached to the foot attaching element and oriented in a plane parallel to said long axis and perpendicular to the foil member.

10. The fin assembly according to claim 1, in which said foil attachment means provides for interchange of said foil member with another foil member having different physical properties for adjustment to a particular swimming requirement.

11. The fin assembly according to claim 1, in which the foot attaching element is a shoe.

12. The fin assembly according to claim 1 that has been molded in one piece.

13. The fin assembly according to claim 1 in which the portion of the foot is a heel.

14. A flexible fin assembly operable when attached to at least one foot of a swimmer, said fin assembly comprising:

A) at least one foot attaching means for attaching to at least one foot, or a portion thereof, of a swimmer;

B) a broad, thin, elastic foil member having a long axis extending from a first end, along a narrow first portion, and a wider second portion to a free edge extending beyond the swimmer's toes, in which the second portion is provided with an arcuate shape curving toward the foot about an axis or axes transverse to the long axis through an angle of between five and ninety degrees; and C) means attaching said first end to said at least one foot attaching means beneath the foot such that, when operated by the swimmer, said foil member will bend in an arc transverse to said long axis away from the ball of the foot held in the foot attaching means when the foot is forced through the water with the dorsum of the foot advancing first and said foil member will bend up toward said ball on an opposite foot motion.

15. The fin assembly according to claim 14, in which there is a single foot attaching means for attaching to one foot.

16. The fin assembly according to claim 14, in which there are two foot attaching means for attaching to two feet.

17. The fin assembly according to claim 16 further comprising tether means extending from said fin assembly for connection to a body part of the swimmer to prevent loss of said fin assembly.

18. The fin assembly according to claim 17 further comprising at least one thin, flat, broad keel element attached to the foot attaching element and oriented in a plane parallel to said long axis and perpendicular to the foil member.

19. The fin assembly according to claim 14, in which said foil attachment means provides for interchange of said foil member with another foil member having different physical properties for adjustment to a particular swimming requirement.

20. The fin assembly according to claim 14, in which the foot attaching element is a shoe.

21. The fin assembly according to claim 14 that has been molded in one piece.

22. The fin assembly according to claim 14, in which the portion of the foot is a heel.

23. A flexible fin assembly operable when attached to at least one foot of a swimmer, said fin assembly comprising:

A) at least one foot attaching means for attaching to at least one foot of a swimmer;

B) a broad, thin, elastic foil member having a long axis extending from a first end, along a narrow first portion, and a wider second portion to a free edge projecting beyond the swimmer's toes, in which the second portion is provided with an arcuate shape curving toward the foot about an axis transverse to said long axis through an angle of between five and ninety degrees; and C) means attaching said first end to a location on said at least one foot attaching means beneath the foot such that, when operated by the swimmer, said foil member will bend in an arc transverse to said long axis and away from the ball of the foot held in the foot attaching means when the foot is forced through the water with the dorsum of the foot advancing first and said foil member will then bend up toward said ball on an opposite foot motion.

* * * * *